US005921415A

United States Patent [19]

Markelz

[11] Patent Number: 5,921,415

[45] Date of Patent: Jul. 13, 1999

[54] BRIDGE ERECTION SYSTEM

[76] Inventor: Paul H. Markelz, 28 W. 231 Oak Creek Dr., West Chicago, Ill. 60185

[21] Appl. No.: 08/887,747

[22] Filed: Jul. 3, 1997

[51] Int. Cl.[6] ..... B66C 23/04

[52] U.S. Cl. ..... 212/294; 212/312; 414/542

[58] Field of Search ..... 414/542; 104/2, 104/3; 212/294, 175, 312, 316, 324, 325, 226

[56] References Cited

U.S. PATENT DOCUMENTS

| | | | |
|---|---|---|---|
| 5,511,268 | 4/1996 | Albus et al. | 212/312 |
| 5,607,071 | 3/1997 | Kroll et al. | 212/226 |
| 5,657,888 | 8/1997 | Kröll et al. | 212/226 |

FOREIGN PATENT DOCUMENTS

| | | | |
|---|---|---|---|
| 59070 | 4/1954 | France | 414/542 |
| 1485492 | 5/1967 | France | 414/542 |
| 259780 | 4/1964 | Netherlands | 414/542 |

*Primary Examiner*—Thomas J. Brahan
*Attorney, Agent, or Firm*—Quarles & Brady, LLP

[57] ABSTRACT

A mobile crane including a wheeled carriage, support members having distal ends, mounted to the carriage and extendable laterally therefrom in two positions including a retracted position with the distal ends adjacent the carriage and an extended position with the distal ends separated from the carriage, first and second glide beams coupled to the distal ends for movement along a movement axis perpendicular thereto, at least one support beam connected to the tops of the glide beams and a hoist trolley coupled to the support beam. The components operate together to provide a fully supported gantry crane having a variable width useful in lifting and transporting various items including items which are wider than the carriage.

26 Claims, 8 Drawing Sheets

BRIDGE ERECTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to an apparatus for assembling elevated structures and more particularly to a portable gantry crane apparatus which is useful in erecting and disassembling railroad bridges.

One commonly used type of crane system is known as a gantry crane. Referring to FIG. 1, a gantry crane 10 includes a plurality of vertical main support members 12, two main girders 14, a trolley girder 16 including parallel tracks 18 on its top surface and at least one trolley 20. The support members 12 support the main girders 14 which in turn support the trolley girder 16. Tracks 22 are also included on the upper surface of the main girders 14 so that the trolley girder 16 can move in either direction parallel to the main girders 14. The trolley 20 is fitted with wheels 24 so that it can move on tracks 18 parallel to the length of the trolley girder 16. A cable 26 extends down from a hoist on the trolley 20 and includes a block and tackle hook 28 at its lower distal end.

In operation, the trolley girder 16 can be moved on the tracks 22 so as to be above any area between the main girders 14. The trolley 20 can be moved so as to be anywhere along the length of the trolley girder 16. The hoist raises and lowers the cable 26 vertically displacing materials or equipment attached to the hook 28.

Gantry cranes are considered relatively safe for a number of reasons. For example, because the trolley girder 16 is supported by a plurality of support members and at least two main girders 14, load forces are distributed among a number of different girders and support members as opposed to a single boom. In addition, assuming that the maximum system load is not surpassed, there is little chance that gantry crane components will be driven into an unstable configuration where the load and system will be unbalanced. Furthermore, because the area between the main girders is free of obstruction, there is little chance that the trolley girder 16, the primary moving component of a gantry crane, will collide with other equipment.

While gantry cranes have many advantages, they are generally not suitable for on-site construction jobs. U.S. Pat. No. 4,497,153 describes one on-site gantry system which illustrates various problems that make onsite gantry systems impractical. The system includes two hoists positioned on, and movable along separate main girders. The hoists cooperate to move prefabricated beams laterally within the area defined by the main girders. The system, as is typical with all gantry systems, requires a complex configuration of support members and girders. Therefore, it is relatively expensive, difficult to transport, and requires a detailed and time consuming setup and takedown protocol.

In addition, the system is immobile after assembly. Thus, once assembled, the system can only transport equipment and materials within the area defined by the main girders. In order to use the system in another area, it must be disassembled, moved, and reassembled in the other area.

These problems have generally limited gantry crane use to permanent operating areas or to small on-site areas.

Another common type of crane system is the mobile level-luffing crane. Referring to FIG. 2, a mobile crane 30 generally includes a carriage 32, a rotating machinery deck 33, operational machinery 34 supported on the deck 33, a hinged boom 36 attached to the machinery deck 33, a first set of topping lines 38, a second set of topping lines 42, and a hook block and tackle 40. The boom 36 is pivotally secured to the machinery deck 33 and operated by increasing and decreasing the length of the first set of topping lines 38. The second set of topping lines 42 is used to raise and lower the hook 40. The carriage 32 and deck 33 are ballasted, thereby adding stability to the crane when loaded.

In FIG. 2, the mobile crane 30 is a locomotive type, being self propelled and fitted with two railroad trucks 44. Power machinery to operate the mobile crane 30 is deck mounted, and the machinery deck is normally completely housed.

The mobile crane 30 overcomes many of the problems associated with a gantry system. For example, many mobile cranes are self propelled and can easily be moved to, and used at, on-site construction locations. In addition, it is not necessary to dismantle a mobile crane in order to move it around a construction site. In fact, often it is not necessary to dismantle a mobile crane to move it from one construction site to another. Furthermore, single beam boom construction makes the mobile crane a more economical option than a gantry system that requires a plurality of beams and support girders. These advantages make the mobile crane a particularly attractive option where crane functions are required for short periods at various construction sites or at different areas within a single large construction site.

Unfortunately, mobile cranes are relatively unsafe. For example, when a mobile crane is loaded and rotated laterally, often the ballast provided by the carriage and machinery deck is insufficient to maintain the crane in a stable position. When unstable, mobile cranes often tip causing damage to both the crane and surrounding structures, and often causing bodily injury to an operator.

Another problem with mobile cranes is that boom movement is not restricted. An unrestricted boom can be pulled back into a vertical position where it collapses over the machinery deck. In addition, as there is no guarantee that the area of boom operation will be free of obstruction, often a mobile crane boom will be mistakenly driven into other construction equipment or environmental structures, causing damage to the boom and other equipment.

While the industry has come up with various solutions to the mobile crane problems identified above, many of the solutions are relatively ineffective in certain industries. In particular, many of the solutions have not been effective in the railroad industry. For example, to stabilize a loaded mobile crane, outriggers or feet (not shown in FIG. 2) are provided which extend laterally from the carriage and contact the surrounding ground. In the railroad industry, while stabilizing outriggers can be used, the degree to which they extend laterally is limited by the construction of a railroad track. As most tracks are positioned on top of a berm, lateral extension is severely limited. Furthermore, as many berms are constructed of coarse rock, often the edge of a berm will be insufficiently stable to support a loaded outrigger. Thus, even when outriggers are used in railroad, because their lateral extension is limited, a mobile railroad crane will often tip when loaded and rotated laterally.

To eliminate the possibility of the boom collapsing over the machinery deck, the industry has come up with boom stops that limit the vertical positioning of the boom. In railroad however, a boom stop can tend to destablize a crane. The boom stop limits the boom to movement wherein the load is located a substantial distance from the ballasting machinery and deck. Because of the distance, the ballast has less stabilizing effect. This, combined with laterally restricted outriggers, results in a tippable and relatively unstable configuration.

The railroad industry uses cranes for many purposes. In particular, the railroad industry uses cranes to assemble, disassemble, and repair bridges on a regular and scheduled basis. Cranes must be used where building materials, such as prefabricated concrete girders, are extremely heavy. Rapid bridge replacement and maintenance is a high priority for any railroad, as train movement is effectively paralyzed when even a small span of track is inoperable. Thus, despite the mobile crane safety problems identified, railroads usually opt for mobile as opposed to gantry crane systems.

To minimize crane accidents, various procedures are regularly followed. For example, to minimize the lateral angle through which a mobile crane boom must rotate, bridge girders are normally pre-delivered to a construction site and placed at a pickup point adjacent a track in front of a train carriage. Because most berms are steep, the pickup point is usually located a substantial distance from the track on relatively flat and solid footing adjacent the berm. Often, where the footing is not solid, support piles must be driven into the footing to support the girders. To pick up materials, the boom must rotate at least partially laterally into a pickup position where the hook is over the pickup point.

Despite predelivery and efforts to limit lateral rotation, often a boom must be rotated substantially laterally in order to pick up a load. Careless operation under these circumstances has resulted in many tipping accidents.

U.S. Pat. No. 2,562,189 describes a gantry crane system which overcomes many of the problems associated with the swing crane systems and which is transportable. This system was designed specifically for transporting coffins and therefore has a relatively modest length. In addition, because coffins are relatively narrow and must often be transported through spaces not much wider than the coffin itself, the width of this system is particularly narrow. Due to its relatively modest dimensions, this system is light weight facilitating easy movement over the short distances typical in a cemetery.

Unfortunately, while this system is transportable, this system would be impractical for lifting and transporting large items such as bridge girders, prefabricated train tracks, or the like. In particular, if this system where adapted for travel along a railroad track, system width would be limited to the width of a typical track plus a typical lateral overhang on either side thereof. Railroad safety standards limit the maximum width of a railroad car to 9 feet, 2 inches (on an 89 foot car). Therefore, assuming a modest clearance of 1 foot, 3 inches for each girder, this system could not be used to pick up and transport bridge and track sections which have a width greater than 6 feet, 8 inches. Many track and girder sections have widths which exceed 6 feet, 8 inches. In fact, many bridge components have a width as wide as 14 feet. Therefore this system would be virtually useless.

Thus, it would be advantageous to have a bridge erection system that is mobile yet stable for transporting heavy construction materials to and from, and moving such materials at, construction sites wherein the width of the materials is equal to or slightly less than the maximum allowable safe transport width. In particular, it would be advantageous to have such a system for use in the railroad industry that could eliminate predelivery requirements, is relatively fast, safe, and efficient.

BRIEF SUMMARY OF THE INVENTION

The present invention includes a crane apparatus comprising a carriage including a deck and at least one truck mechanism connected to an undersurface of the deck, the deck including forward and rearward edges and first and second lateral edges. The invention also includes at least one support member having a distal end, the support member mounted to the deck such that the distal end is laterally extendable from the first edge, first and second glide beams, the first beam coupled to the distal end for movement along a movement axis parallel to a first beam length, the second beam coupled to the deck so as to be essentially parallel and spaced apart from the first beam and for movement essentially parallel to the movement axis, at least one support beam having first and second ends, the first end coupled to the top of the first glide beam and the second end coupled to the top of the second glide beam, the support beam having a variable length component perpendicular to the first glide beam length and at least one lifting mechanism coupled to the support beam, the lifting mechanism including a strand having upper and lower ends and a connector connected to the lower end. With the present invention, the support member is moveable between at least a retracted position and an extended position, when in the retracted position, the distal end adjacent the first lateral edge and when in the extended position, the distal end separated from the first lateral edge, and, wherein, the glide beams are moveable parallel to the movement axis relative to the carriage.

Thus, one object of the invention is to provide a transportable crane system having a width which can be extended laterally so that items which are wider than the crane when the crane is in a transportable retracted configuration can be lifted and moved despite transport configuration limitations. To this end, the support member can be driven laterally to increase the distance between the first and second glide beams thereby increasing the maximum width of an item which can be lifted and transported.

In one embodiment the carriage is a flat bed train car and the truck mechanism consisting of two train trucks.

An object related to the object above is to provide a system of the above kind which is useful in the railroad industry. In the railroad industry, railroad car width is restricted primarily for safety purposes. With the present invention, the width of the crane system can be minimized during crane transport and can then be increased to the expanded width during lifting operations.

One other object is to provide a mobile crane system wherein it is practically impossible for the system to laterally tip. By limiting movement of the glide beam controlled lateral movement and a single longitudinally supported axis, lateral rotation, and thus lateral tipping, is eliminated.

In one aspect the support member is a first support member and the apparatus further includes a second support member having a distal end and mounted to the deck such that the distal end is laterally extendable from the second edge, the second glide beam coupled to the second support member distal end for movement along the movement axis.

One other object of the invention is to provide a relatively wide gantry crane system yet still maintain lateral stability. By providing a system which symmetrically extends laterally on both sides of the carriage, stability is maintained.

In another aspect the first and second support members are a first member pair and the apparatus further includes at least a second support member pair including third and fourth support members having distal ends, the first and second pairs spaced apart along the deck length between the forward and rearward edges, the first glide beam coupled to the first and third support member distal ends and the second glide beam coupled to the second and fourth support member distal ends for movement along the movement axis. Preferably, the apparatus includes more than two support member pairs spaced apart along the deck length.

In yet another aspect, the support beam has a fixed length which forms a variable angle with the first glide beam length and is pivotally coupled at the first and second ends to the tops of the first and second glide beams, the variable angle and support beam length component perpendicular to the first glide beam changeable as the support member is moved between the retracted and extended positions.

One other object is to provide a variable width gantry crane wherein support beams for hoist assemblies are formed of single integral beam members despite the requirement that they change length in he direction perpendicular to the glide beams. To this end, the support beams form an angle with the glide beams and the angle changes during extension or retraction to provide additional strength to the system.

Preferably the support beam is a first support beam and the apparatus further includes a second support beam spaced apart from the first support beam, the second support beam having first and second ends which are coupled for pivotal movement to the tops of the first and second glide beams, respectively, the first and second support beams arranged such that they are essentially parallel, the lifting mechanism coupled to and supported by both the first and second support beams. This configuration adds additional strength to support the hoist assembly.

In another aspect upper edges of the first and second glide beams form channels which extend along at least a portion of respective glide beams, the support beam coupled to first and second roller assemblies at first and second ends, respectively, the roller assemblies receivable within the channels and moveable therealong so as to change the position of the support beam relative to the glide beams. In addition, an upper edge of the support beam upper forms a channel and the lifting mechanism includes a roller assembly receivable within the channel and moveable therealong so as to change the position of the lifting mechanism along the length of the support beam.

Yet another object is to provide gantry support for a hoist assembly within the area defined by two glide beams. When the beams are above the carriage, the hoist assembly can be located at various points above the deck. When the beams are extended and adjacent either a forward or rearward edge of the carriage, the hoist assembly can be located above an area adjacent the deck between extended portions of the glide beams.

Also, preferably, two support beams, each fitted with a separate hoist assembly, are connected for movement along the length of, and between, the glide beams.

Another object is to provide means for safely lifting a long item, and specifically for lifting a bridge girder for movement. By positioning the two hoist assemblies above different ends of a girder, the hoist assemblies operate together to lift and move a girder laterally between the beams.

By lifting construction items over the deck, as opposed to rotating the items laterally relative to the deck, lateral tipping is eliminated. In addition, as the present invention can safely pick up even heavy materials from an area behind the deck, it is not necessary to pre-deliver materials to a construction site or to use pile supports. Materials can be supplied on a separate supply car connected behind the deck.

Importantly, the deck may form a carrying surface. Thus, another object is to provide a crane system where the system can also carry girders or other construction materials to a construction site. Preferably, a motorized motivation means is included for moving the glide beams relative to the deck.

The foregoing and other objects, aspects and advantages of the invention will appear from the following description. In the description, reference is made to the accompanying drawings which form a part hereof, and in which there is shown by way of illustration preferred embodiments of the invention. Such embodiments do not represent the full scope of the invention. Reference is made therefore to the claims herein for interpreting the full scope of the invention.

DETAILED DESCRIPTION OF THE INVENTION

Figure 5:
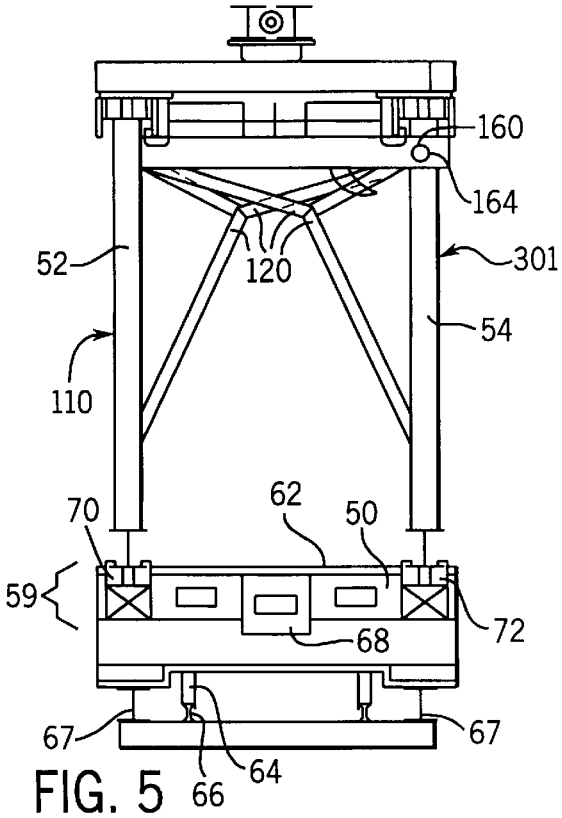
FIG. 5 is an end view of the system shown in FIG. 3 with the system in a retracted position.
Figure 6:
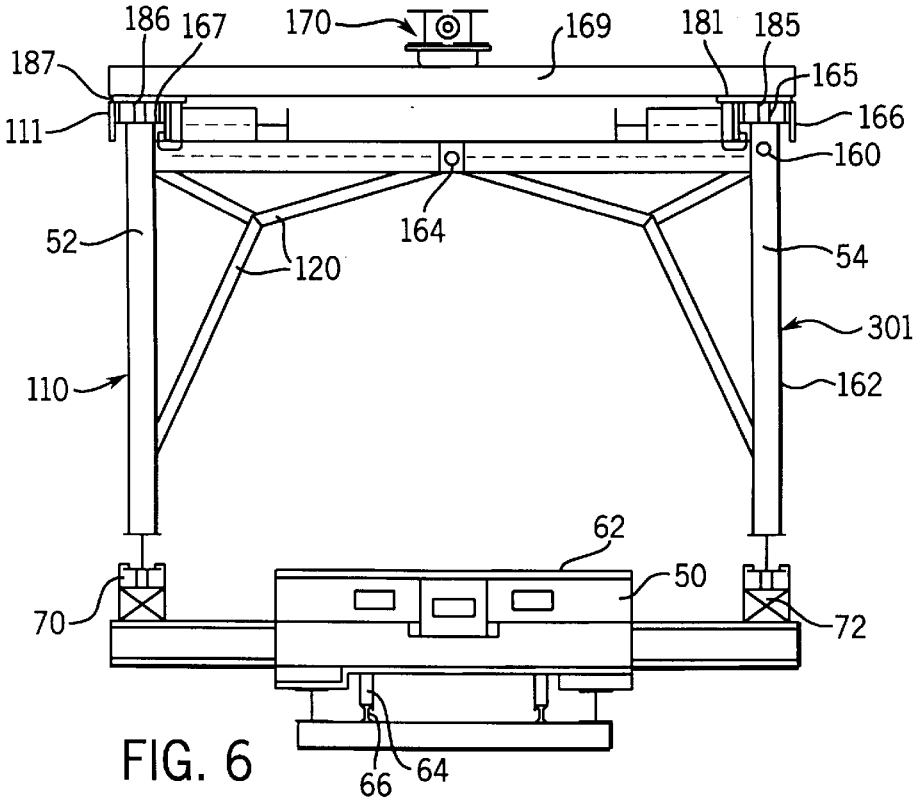
FIG. 6 is similar to FIG. 5, albeit with the system in an expanded position.

Generally speaking, referring to FIGS. 5 and 6, the present invention allows a crane assembly which has a maximum allowable width during transport to easily be widened at a construction cite for lifting and moving construction items that would be to wide for movement with the crane in the transport configuration. FIG. 5 shows the inventive assembly in a transport configuration while FIG. 6 shows the assembly in a wide lifting configuration.

A. System Hardware Referring now to FIGS. 3 and 5, an inventive crane system 48 includes a carriage 50, first and second glide truss assemblies 52, 54 (see FIG. 12), first and second crane assemblies 56, 58 (see FIG. 11), a lateral extension assembly 59 (see FIG. 7), and various other components described in more detail below. Carriage 50 is preferably a flat elongated rectangular member similar to the flat bed of a truck or the flat bed of a railroad car. The carriage 50 provides a flat, substantially horizontal deck 62.

Figure 1:
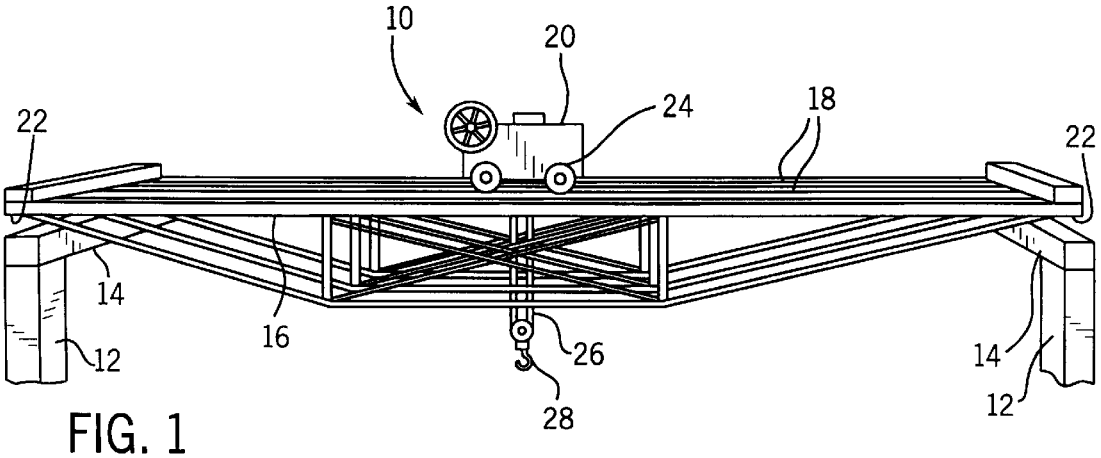
FIG. 1 PRIOR ART
FIG. 1 is a prior art gantry crane system.
Figure 2:
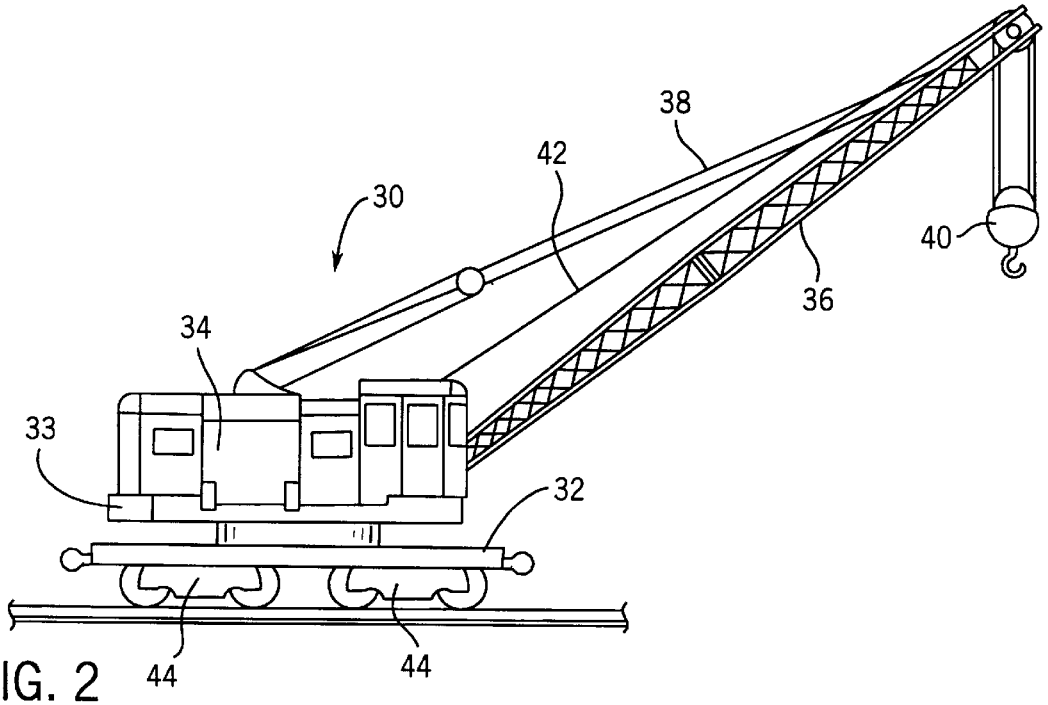
FIG. 2 PRIOR ART
FIG. 2 is a prior art mobile locomotive crane system.
Figure 3:
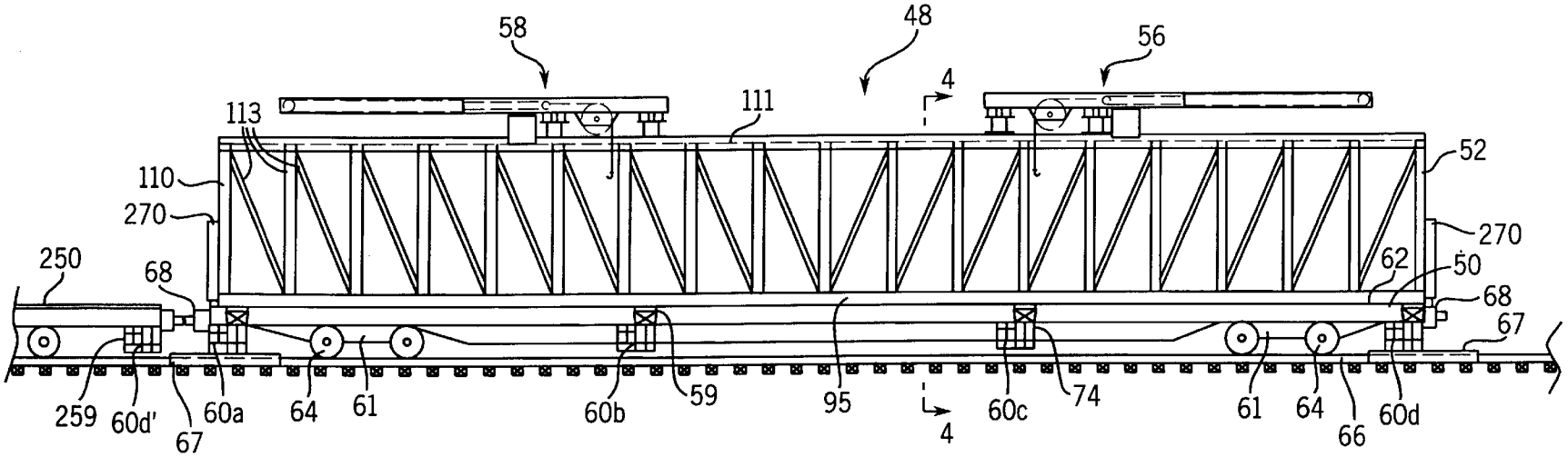
FIG. 3 is a side elevational view of a crane system according to the present invention.
Figure 4:
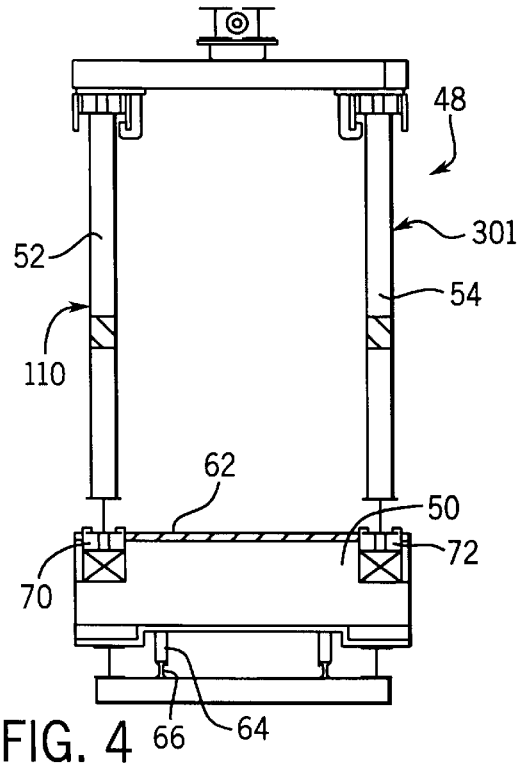
FIG. 4 is a cross-sectional view of the system shown in FIG. 3 taken along the line 4—4.

In the preferred embodiment shown in FIGS. 3 and 4, the invention is configured for use in conjunction with a railroad. To this end, the carriage 50 is supported by two railroad trucks collectively referred to by the numeral 61 which are positioned beneath the carriage 50, one truck 61 on either end. Each truck 61 includes a plurality of wheels 64 spaced apart in accordance with the specifications of a railroad track 66 therebelow. Each truck 61 also includes an automatic coupler 68 extending longitudinally further than carriage 50. Couplers 68 cooperate with couplers on other railroad cars for attachment thereto.

Figure 7:
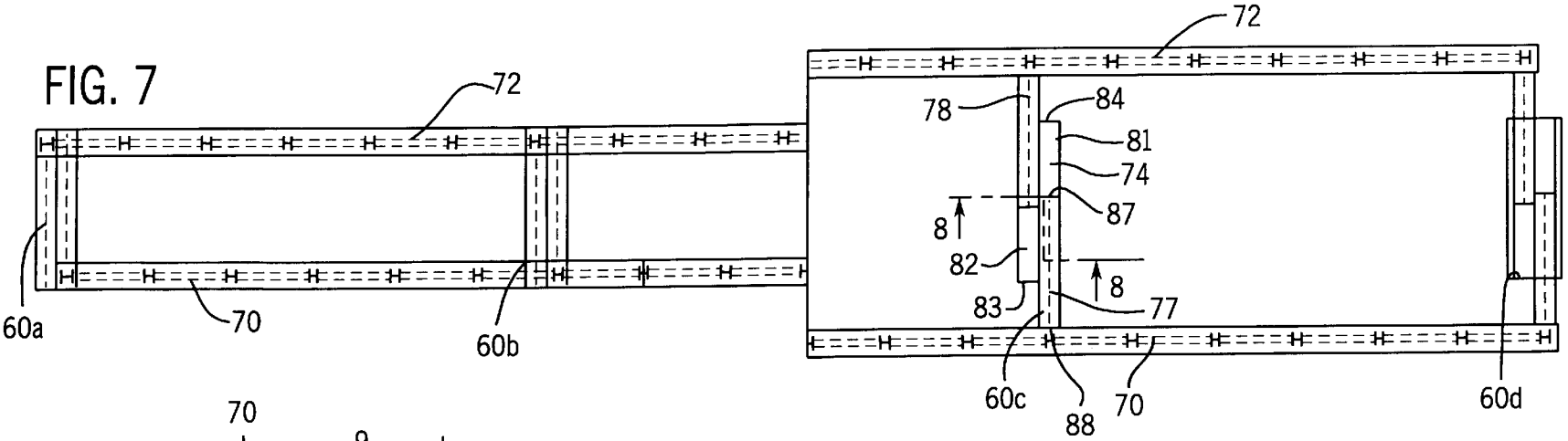
FIG. 7 is a top plan view of a lateral extension assembly according to the invention.

Lateral extension assembly 59 is used to increase the distance between trusses 52 and 54 to accommodate relatively wide construction items. Referring to FIG. 7, the left half of that figure illustrates assembly 59 in a retracted transport configuration while the right half illustrates assembly 59 in an expanded configuration. Assembly 59 includes a plurality of support assemblies 60*a*, 60*b*, 60*c* and 60*d* and first and second lateral beams 70 and 72. Assemblies 60*a* through 60*d* are identical and therefore only assembly 60*c* will be explained here in detail.

Figure 8:
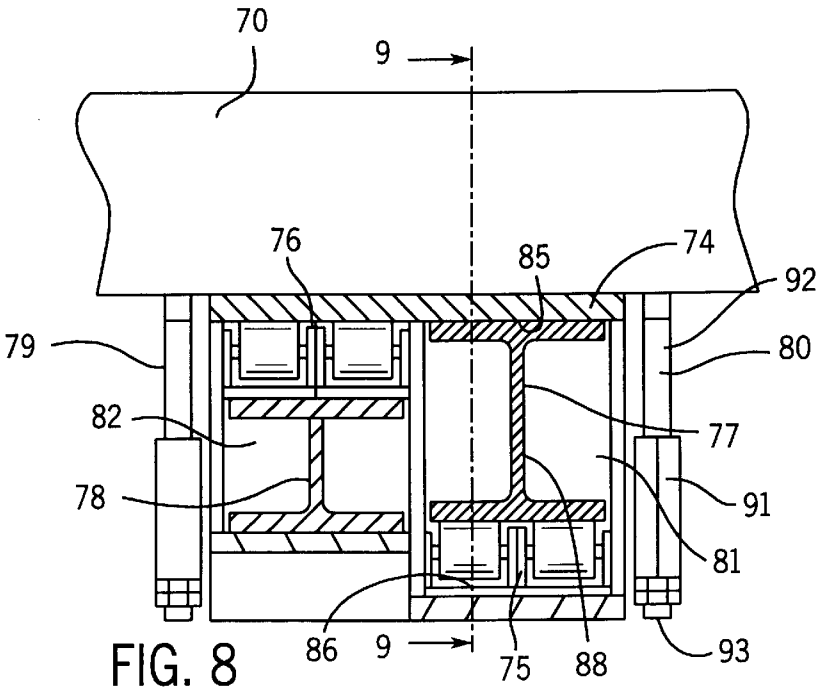
FIG. 8 is a cross-sectional view taken along the line 8—8 of FIG. 7.
Figure 9:
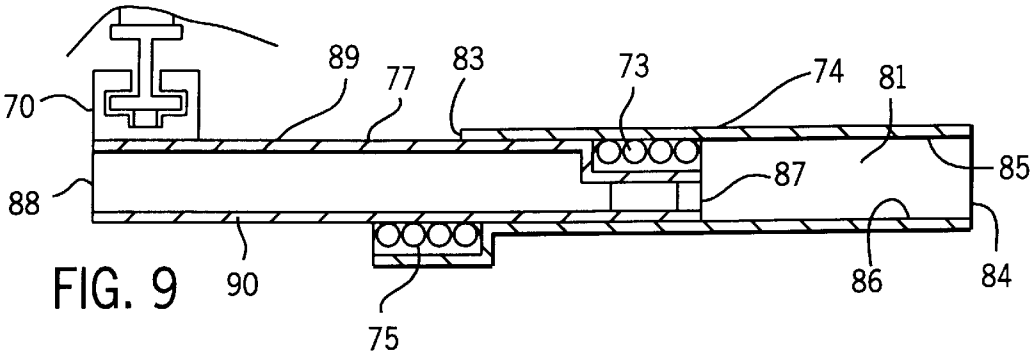
FIG. 9 is a cross-sectional view taken along the line 9—9 of FIG. 8.

Referring also to FIGS. 8 and 9, assembly 60*c* includes a sleeve member 74, first 73, second 75, third (not illustrated) and fourth 76 roller assemblies, a support member pair including first and second support members 77, 78 and first and second stabilizer assemblies 79, 80. Sleeve 74 forms first and second parallel channels 81, 82, each channel 81, 82 is open at first and second opposite ends 83, 84 and each channel having an upper inner surface and a lower inner surface 85, 86, respectively.

Assemblies 73, 75 and 76 are typical roller assemblies including a plurality of wheels mounted on parallel axis to facilitate roller action perpendicular to the axis. Second assembly 75 is secured to lower surface 86 adjacent first end 83 to facilitate movement therealong. Similarly, although not illustrated, the fourth roller assembly is secured to a lower surface of channel 82 adjacent second end 84.

Support members 77 and 78 are essentially identical and therefore only first member 77 will be explained here in detail. Referring to FIGS. 7 through 9, member 77 is a beam having proximate and distal ends 87, 88 and upper and lower surfaces 89, 90. First roller assembly 73 is secured on the upper surface at proximate end 87 and lateral beam 70 is secured to the upper surface 89 at the distal end 88. Preferably, two strengthening members 91 are welded into proximate end 87 for support.

When assembled, proximate end 87 is received inside channel 81 with assembly 73 bearing on upper surface 85 and assembly 75 bearing on surface 90 such that assemblies 73 and 75 cooperate to allow easy movement of support member 77 between the retracted (see FIG. 5) and expanded (see FIG. 6) positions. Similarly, member 78 is received inside channel 82 for movement in the opposite direction.

Referring again to FIGS. 3 and 4, sleeve 74 is secured to the under surface of carriage 50 such that distal ends 88 are laterally displaced on opposite sides of deck 62.

Referring again the FIG. 8, stabilizer assemblies 79, 80 are provided on opposite sides of sleeve 74. Assemblies 79, 80 can be connected to sleeve 74 in any known manner, but should be connected so that, when extended, they clear the other system components therebelow. Each assembly 79, 80 includes a hydraulic tube 91, a telescoping extension member 92 which is stored in tube 91, and a foot member 93 connected to the distal end of member 92.

Members 92 can be placed in a stored position (see FIG. 8) wherein the member 92 is fully retracted. Members 92 can also assume operating positions wherein they are fully extended so that foot 93 contacts a secure surface therebelow. When truss assemblies 52 and 54 or support members 60*a* through 60*d* are being moved, members 92 are in the retracted position. When assemblies 52, 54 and/or members 60*a* through 60*d* are stationary, preferably, although not necessarily, members 92 should be extended.

Referring also to FIG. 3, spreader beams collectively referred to by the numeral 67 are provided at and connect the distal ends of adjacent members 92. When members 92 are expanded, beams 67 contact rail road ties or the like thereunder and provide stability to carriage 50 thereabove.

To move assembly 72 from the retracted to the extended positions and vice versa, any manner known in the art can be used including hydraulics, cables and winches or separate servo motors. Although not illustrated, preferably a hydraulic motor system is provided to facilitate desired movement under remote operator control.

Figure 10:
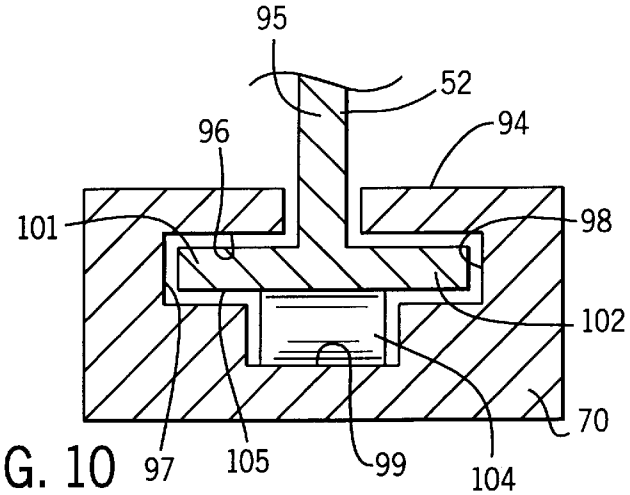
FIG. 10 is a cross-sectional view of a lateral beam of FIG. 4.

Lateral beams 70 and 71 are essentially identical and therefore only beam 70 will be described here. Referring to FIG. 10, an upper edge 94 of beam 70 forms a channel 96 for receiving and supporting the bottom I-beam 95 of truss assembly 52 for movement therealong. To this end, channel 96 includes oppositely facing lateral passages 97 and 98 and a roller recess 99. A plurality (one illustrated) of roller assemblies 104 are provided along the length of recess 99. Lateral extensions 102 and 103 at the bottom of beam 95 are received within passages 97 and 98 and a lower surface 105 of beam 95 rests on roller assembly 104 which facilitates I-beam movement. Thus, with I-beams 95 supported for movement within and along channel 96, trusses 52 and 54 can move along beams 70 and 71 and thereby along the length of carriage 50.

Figure 12:
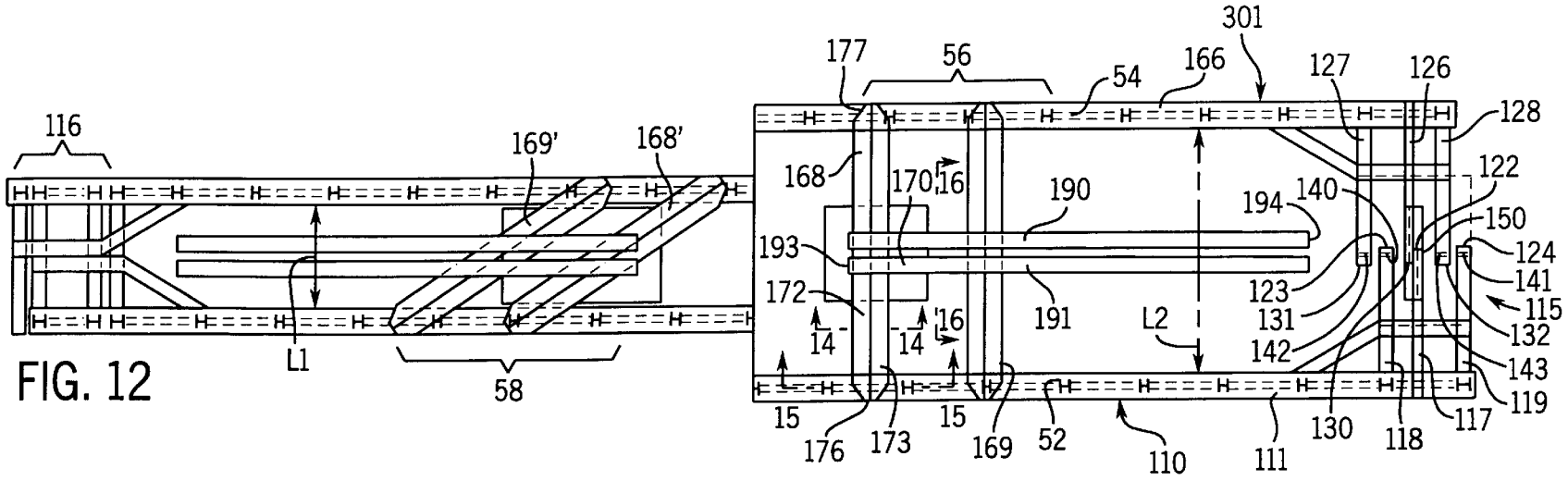
FIG. 12 is a top plan view of a truss assembly according to the present invention.

Referring to FIGS. 3 through 6 and 12, truss assemblies 52 and 54 are essentially identical and therefore, unless necessary to describe how the two assemblies 52 and 54 cooperate, only assembly 52 will be explained in detail here. In FIG. 12 assemblies 52 and 54 are illustrated in the retracted and expanded configurations on the left and right hand sides, respectively. Truss assembly 52 includes a glide beam 110 and a plurality of brace beams 117, 118 and 119 (see FIGS. 12 and 13). A beam which is similar to beam 110 and is associated with assembly 54 is identified by numeral 301 (see FIG. 6). Beam 110 includes parallel upper and lower beams 111 and 95, respectively, and a plurality of latticed supporting beams collectively referred to by the numeral 113 which traverse the distance between beams 95 and 111. The distance between beams 95 and 111 will typically be on the order of ten to sixteen feet.

Figure 13:
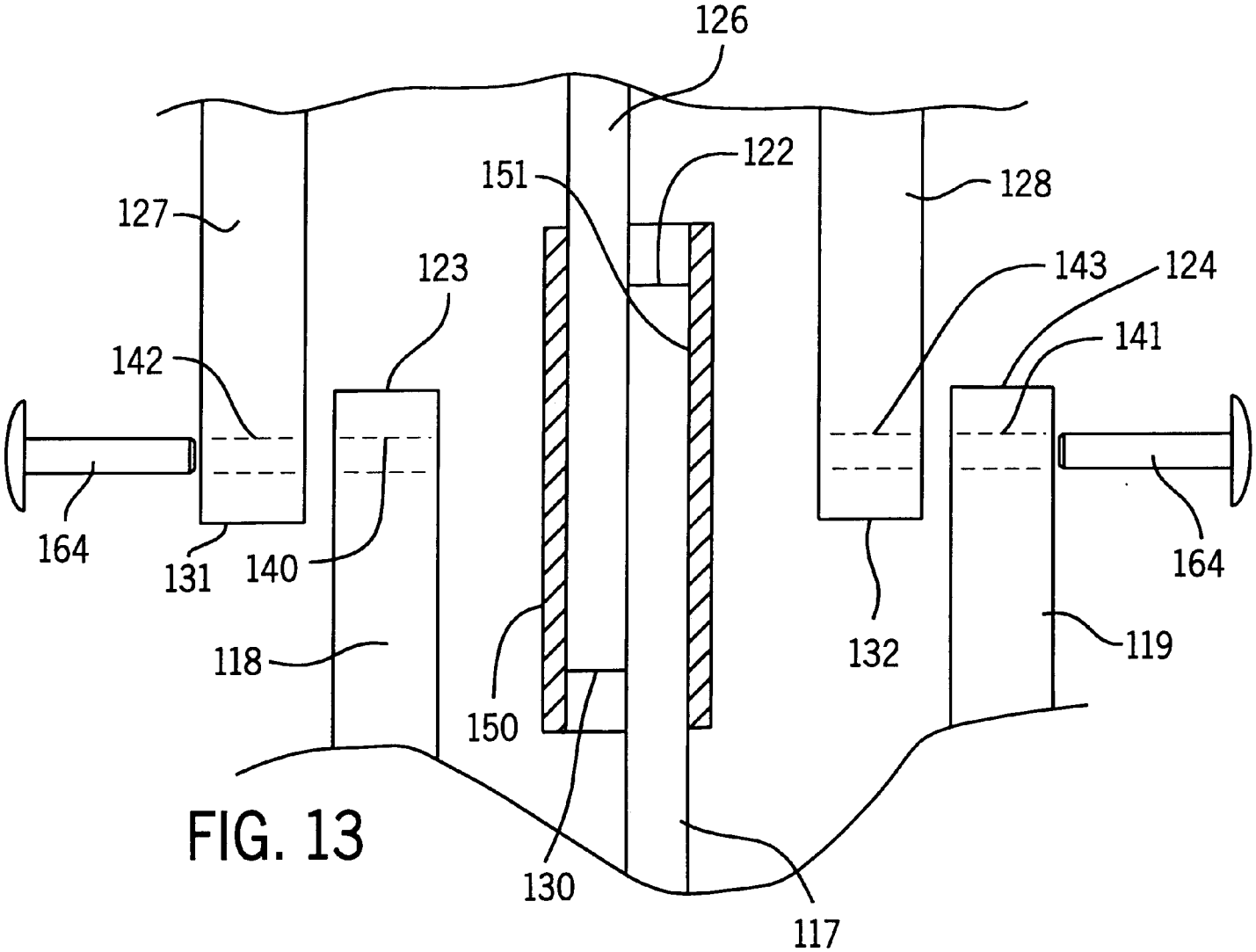
FIG. 13 is a partial enlarged view of the brace members of FIG. 12.

Referring specifically to FIGS. 12 and 13, the brace beams include first and second sets of beams 115, 116, one set at either end of beam 110. Sets 115 and 116 are essentially identical and therefore only set 115 will be explained here. Set 115 includes a stabilizer beam 117 and two locking beams 118, 119, one on either side of beam 117. All beams 117, 118 and 119 are secured at proximal ends below upper beam 111 and extend perpendicular thereto toward truss assembly 54 terminating at distal ends 122, 123 and 124, respectively. As seen in FIGS. 5 and 6, a lattice of support beams collectively referred to by the numeral 120 are provided to support beams 117, 118 and 119 in their perpendicular positions. Distal ends 123 and 124 form locking apertures 140 and 141 therethrough.

Three similar beams, including a stabilizer beam 126 and two locking beams 127, 128, one on either side of beam 126, extend from just below the upper beam of assembly 54 toward assembly 52 (see FIG. 12). Each of beams 126, 127 and 128 terminate at distal ends 130, 131 and 132, respectively, and distal ends 131 and 132 form locking apertures 142 and 143 similar to apertures 140 and 141.

An elongated sleeve 150 forms a single channel 151 which is open at both ends and is formed to slidably receive distal ends 122 and 130, thereby maintaining ends 122 and 130 parallel. When truss assemblies 52 and 54 are mounted on carriage 50, beams 117 and 126 are adjacent and received in channel 151. In addition, beams 118 and 127 are adjacent and beams 119 and 128 are adjacent (see FIG. 13). A locking aperture 160 is also provided in the upper end of an end support beam 162 (see FIG. 6).

Beams 117 and 126 and sleeve 150 cooperate to provide sufficient support to assemblies 52 and 54 during movement between the expanded and retracted positions and vice versa. While they do provide some support for assemblies 52 and 54 during lifting or transport operations, beams 117 and 126 are not provided for this purpose.

When assemblies 52 and 54 are in the expanded configuration (see righthand side FIG. 12), apertures 140 and 142 align and apertures 141 and 143 also align. When expanded with apertures 140, 142 and 141, 143 aligned, one or more locking members collectively referred to by numeral 164 can be forced through adjacent apertures to lock adjacent beams together and provide end support to truss assemblies 52 and 54. To secure assemblies 52 and 54 in the retracted position for transport or for lifting narrow items, once the retracted position is attained, members 164 can again be used to lock assemblies 52 and 54 relative to each other via apertures 141 and 160 (see FIG. 5).

Referring to FIG. 6, I-beams 111 and 166 at the top of truss assemblies 52 and 54 are configured so that each forms an upwardly opening channel 167, 165, respectively, for receiving roller assemblies therein.

Figure 11:
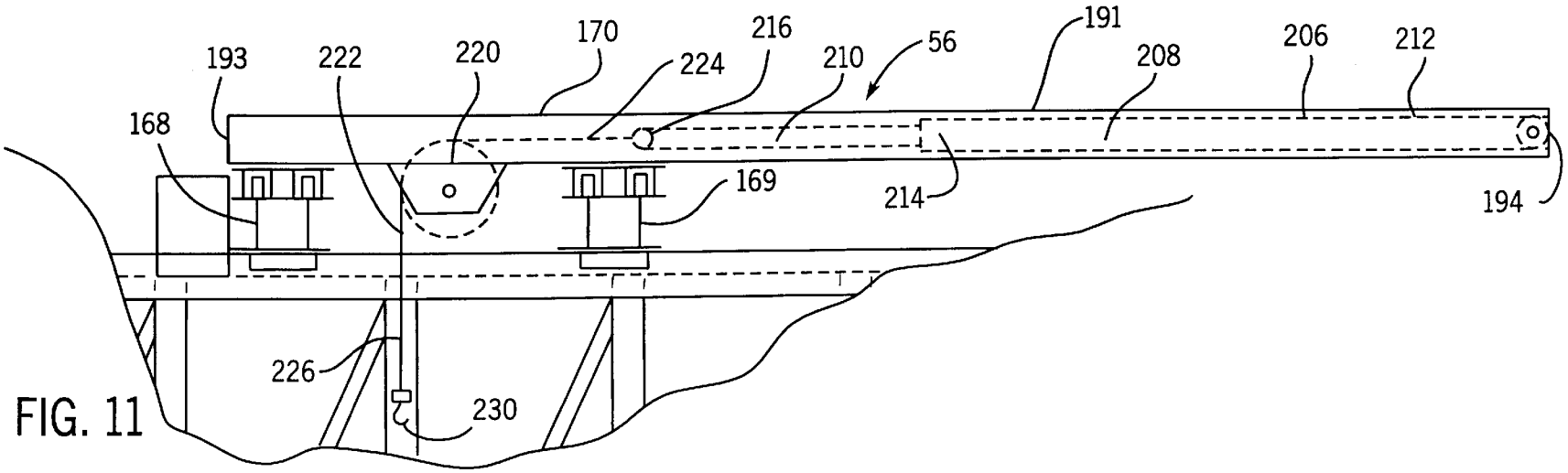
FIG. 11 is a partial enlarged view of the hoist assembly of FIG. 3.

Referring again to FIG. 3, each of the first and second lifting mechanism or crane assemblies 56, 58 is essentially identical except that they are positioned in different locations. Therefore, only assembly 56 will be explained here. Referring also to FIGS. 6, 11 and 12, assembly 56 includes first and second support beams or assemblies 168, 169 and a hoist assembly 170. Each of assemblies 168 and 169 are essentially identical and therefore only assembly 168 will be explained here.

Figure 14:
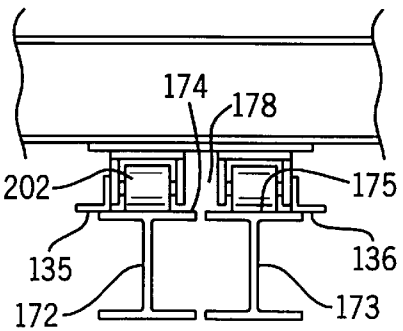
FIG. 14 is a cross sectional view taken along the line 14—14 of FIG. 12.

Referring specifically to FIGS. 12 and 14, assembly 168 includes two parallel I-beams 172, 173 which traverse the distance between upper beams 111 and 166. Each beam 172 and 173 has an upper surface 174, 175, respectively, and first and second ends 176, 177, respectively. Along opposite and spaced apart edges of upper surfaces 174 and 175 first and second "L" shaped track members 135, 136 are welded so as to form a roller assembly receiving channel 178 therebetween.

Figure 15:
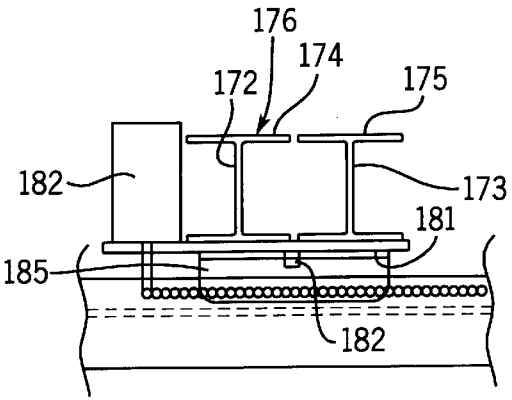
FIG. 15 is a cross sectional view taken along the line 15—15 of FIG. 12.

Referring also to FIG. 15, end 176 is integrally attached to a pivot plate 181 which includes a centrally located and downwardly extending pivot post 182. A hydraulic motor 183 is also provided on plate 181. Similarly, end 177 is attached to a pivot plate 187 (see FIG. 3) having a downwardly extending post (not illustrated).

Referring to FIGS. 3, 6 and 15, a roller assembly 185 is pivotally secured beneath plate 181 (i.e. post 182 is received for rotation within a suitably sized aperture). Similarly a roller assembly 186 is secured beneath plate 187 at the other end of beams 172, 173. Assemblies 185 and 186 are received in channels 165 and 167 along beams 111 and 166 (see FIGS. 6 and 12). Thus, beams 172 and 173 are moveable along channels 165 and 167. Motor 183 facilitates movement along channels 165 and 167 via hydraulic lines (not shown) connected and supplied by motor 182 in any manner known in the art.

Referring to FIGS. 6, 11, 12 and 16, hoist assembly 170 can be any type of hoist assembly known in the art which can raise and lower a cable below assemblies 168 and 169. Preferably, assembly 170 includes first and second I-beams 190, 191 which are adjacent and parallel, have proximal and distal ends 193, 194, respectively, and form a channel 195 therebetween. Ends 193 are coupled to assembly 168, beams 190 and 191 extending therefrom over and past assembly 169. Beams 190 and 191 are also coupled to assembly 169 at the point where they cross there-over.

Figure 16:
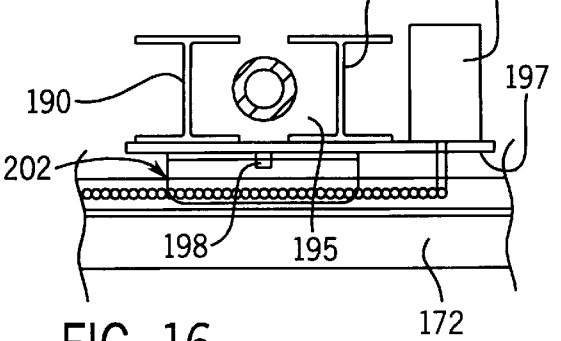
FIG. 16 is a cross sectional view taken along the line 16—16 of FIG. 12.

Coupling of beams 190 and 191 is similar to the couplings of ends 176 and 177 to beams 111 and 166. Thus, distal ends 193 are secured to a pivot plate 197 having a pivot post 198 extending centrally and downwardly therefrom. Another hydraulic motor 199 is provided on plate 197. Referring to FIGS. 14 and 16, post 198 is received in a suitably sized aperture in the top of a roller assembly 202 which is in turn received in channel 178 for movement therealong. Although not illustrated, beams 190 and 191 are similarly coupled to assembly 169 via a pivot plate and a roller assembly such that beams 190 and 191 can move along assembly 169 between truss assemblies 52 and 54.

Referring to FIGS. 11 and 16, a telescopic hydraulic ram assembly 206 is secured between beams 190 and 191. Ram 206 includes a sleeve 208 and an extension member 210. Sleeve 108 has proximal and distal ends 212, 214 and is secured at proximal end 212 to the distal ends 194 of beams 190 and 191. Member 210 is received within sleeve 208 and has a distal end 216 which extends from distal end 214. A pulley 220 is mounted for rotation between beams 190 and 191 and between assemblies 168 and 169. A cable or lifting strand 222 has proximal and distal ends 224, 226, respectively. End 224 is secured to end 216 of member 208. Cable 22 passes between beams 190 and 191, over pulley 220 and extends downwardly to end 226. A hook, electromagnet or some other securing device 230 is secured to end 226.

In operation, a hydraulic pump provides hydraulic fluid to ram 206 to move distal end 216 relative to pulley 220. As end 216 moves, hook 230 is raised and lowered below pulley 230.

Referring once again to FIG. 3, a second flat bed train car 250 is illustrated. Car 250 is fitted with a lateral extension assembly 259 identical to assembly 59 described above. Therefore, car 250 can support truss assemblies 52 and 54 in the same manner as assembly 59. Having two or more train cars fitted with lateral extension assemblies is particularly useful as will become apparent below.

Referring to FIG. 3, telescopic supports collectively referred to by numeral 270 are provided at the ends of assemblies 52 and 54. Supports 270 are essentially the same as assemblies 79 and 80 and therefore are not described here in detail. Suffice it to say that supports 270 can extend downwardly to a surface therebelow to provide additional support to assemblies 52 and 54, especially when assemblies 52 and 54 are in extended positions.

B. Operation

In operation, referring to FIGS. 3, 4 and 5, with assemblies 59, 52 and 54 in the retracted configuration, locking members 164 (see FIG. 13) can be used to secure beams 118 and 127 and beams 119 and 128 to provide end support to assemblies 52 and 54 for transport. In this configuration the width of system 48 should meet conventional safety standards for railroad travel. Also, in this configuration, assemblies 168 and 169 will form acute angles with beams 111 and 166 and will have a beam length component L1 which is perpendicular to glide beam 110 and beam 111 (see FIG. 12). In other words, assemblies 168 and 169 will be arranged like assemblies 168' and 169' on the left-hand side of FIG. 12. Moreover, beams 190 and 191 will be arranged so as to be parallel to beams 111 and 166 (see 190' and 191' on left-hand side FIG. 12).

System 48 can be transported to a construction site (e.g. a bridge to be disassembled and replaced) either by a motor integrally provided with system 48 or under tow. Once at a construction cite, assuming a construction item which is wider than the distance between assemblies 52 and 54 needs to be picked up and moved, locking members 164 are removed so that assemblies 60*a* through 60*d* can be driven from the retracted into the extended configurations. With members 164 removed, members 77 and 78 associated with each assembly 60*a* through 60*d* are driven laterally outwardly forcing lateral beams 70 and 72 and assemblies 52 and 54 away from carriage 50 in opposite directions. As assemblies 52 and 54 are driven outwardly, assemblies 168 and 169 (and assemblies 168' and 169') pivot at both ends 176 and 177 from the positions illustrated on the left-hand side of FIG. 12 to the positions illustrated on the righthand side of FIG. 12. After extension, the beam length component perpendicular to glide beam 110 (i.e. beam 111) will be L2. Preferably, once the extended configuration is attained, assemblies 168 and 169 are not precisely perpendicular to beams 111 and 166, but instead are slightly skewed (e.g. 3 to 5 degrees) toward their retracted positions. Upon retracting members 77 and 78, this skewing causes assemblies to "fold" back into their original retracted positions instead of attempting to fold in the opposite direction.

With assemblies 52 and 54 in the extended configuration and apertures 140 and 142 aligned and apertures 141 and 143 aligned, members are inserted therethrough (see FIG. 13) to lock brace beams 118, 127 and 119, 128 together. A similar locking procedure is performed at both ends of assemblies 52 and 54. Prior to moving assemblies 52 and 54 along beams 70 and 72, stabilizer assemblies 79, 80 should be extended to provide added support to carriage 50.

Figure 17:
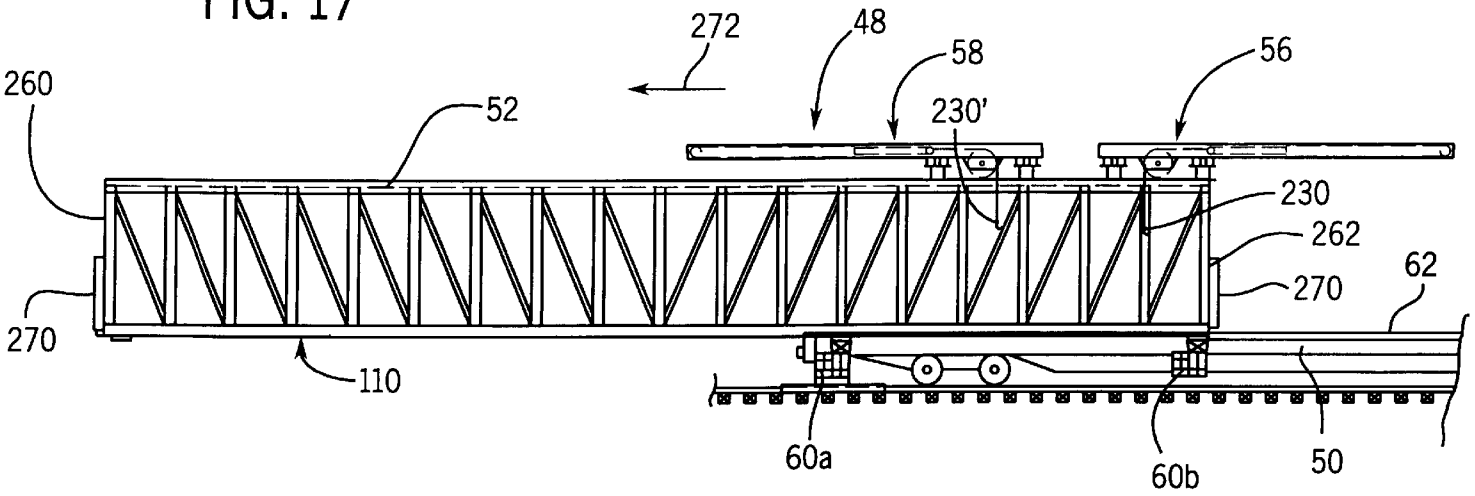
FIG. 17 is a side elevational view of the assembly of FIG. 1 with the truss assembly extended from a rail car.

Next, one of two different general types of operations can be performed. First, referring to FIG. 17, where only one train car is used to lift an item, truss assemblies 52 and 54 can be driven along beams 70 and 72 in a direction so as to place a first end 260 of assemblies 52 and 54 above an item to be moved. For the purposes of this explanation, although assemblies 52 and 54 could be moved in either direction along the lengths of beams 70 and 72, it will be assumed assemblies 52 and 54 are moved in such that sections of assemblies 52 and 54 remain above assembly 60*a*.

Assemblies 52 and 54 can be driven to the point where a second end 262 opposite end 260 is just above assembly 60*b*. In this case, assemblies 52 and 54 are supported by assemblies 60*a* and 60*b*. When assemblies 52 and 54 are in a position over an item to be moved, supports 270 can be extended downwardly. This is especially true at end 260 to provide support thereat. Next, assemblies 58 and 56 are moved in the direction indicated by arrow 272 until hooks 230 and 230' are above the item to be lifted. Assemblies 58, 56 are driven to lower hooks 230 and 230', hooks 230, 230' are secured to the item to be lifted, and assemblies 58 and 56 are driven to lift the item below assemblies 168 and 169. With the item lifted, assemblies 58 and 56 are moved in a direction opposite arrow 272 to move the item into an area over deck 62.

The lifted item can be placed on deck 62 for transport or, in the alternative, can be placed on a different car for removal. If desired, a plurality of rollers (not illustrated) can be provided on the surface of deck 62 to facilitate item movement therealong. For example, once one end of an item is placed on deck 62, hook 230 can be removed from the item and assembly 58 along could be used to move the item along deck 62.

After supports 270 are retracted, assemblies 52 and 54 can be moved back over carriage 50 or can be driven off the opposite side of carriage 50 to further move an item to a different car for further transport.

Figure 18:
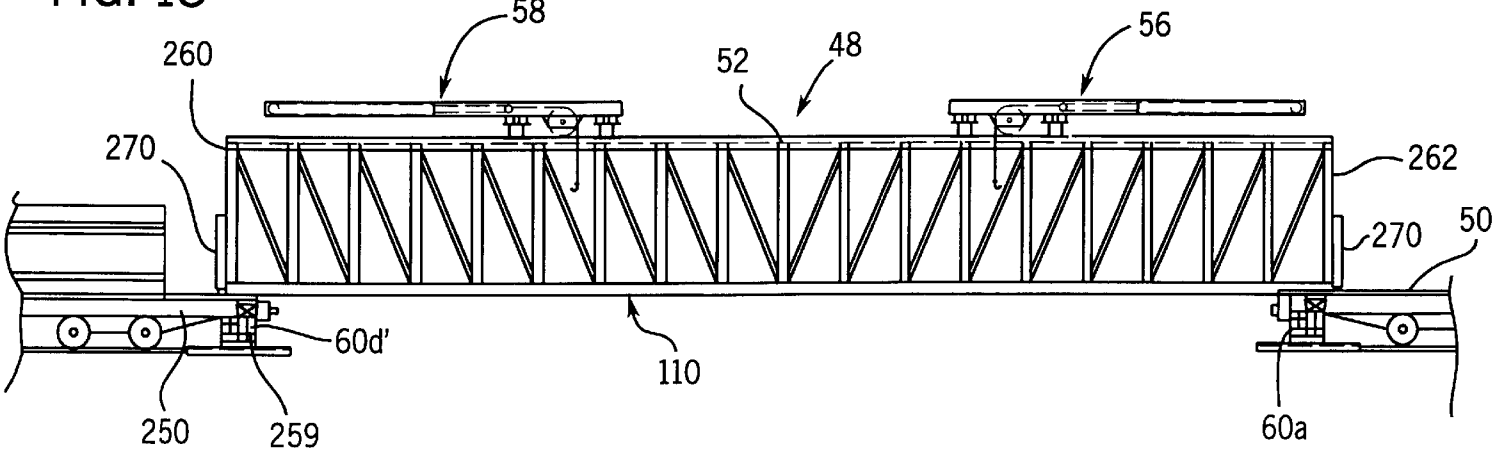
FIG. 18 is similar to FIG. 17, albeit with the truss assembly supported by two rail cars.

Second, referring to FIG. 18, system 48 can be used with a second car 250 fitted with a lateral extension assembly 259 to provide enhanced lifting operations. In this case, with assemblies 52 and 54 in the extended configuration (see FIG. 6) and associated assembly 259 in an identical extended configuration, assemblies 52 and 54 are driven out past assembly 60*a* and over an adjacent car 250 and associated assembly 60*d'* (see FIG. 3). End 260 of assemblies 52 and 54 is secured to assembly 60*d'*. Car 250 is driven away from assembly 60*a* pulling assemblies 52 and 54 therewith until end 262 is directly above assembly 60*a*. In this case, assemblies 52 and 54 form a bridge from assembly 60*a* to 60*b* and hoist assemblies 58 and 56 can be used to raise and lower items therebetween. Here, assemblies 58 and 56 can only be used between assemblies 52 and 54, it is particularly advantageous to provide roller assemblies on surfaces 62.

FIG. 18 illustrates assembly 48 configured after a bridge section has been removed. After a bridge has been replaced under assemblies 52 and 54, car 250 is driven back toward assembly 60*a* thereby driving assemblies 52 and 54 back over carriage 50. End 260 is disconnected from assembly 60*d'* and assemblies 52 and 54 are secured to carriage 50 in any manner known in the art.

To prepare system 48 for transport, members 164 are removed and members 70 and 72 are retracted under carriage 50 to decrease the distance between assemblies 52 and 54. Once in the retracted configuration (see FIG. 5), members 164 are inserted in appropriate apertures to lock assemblies 52 and 54 together. Once locked in the retracted configuration, system 48 can be moved to another construction cite for similar use.

Thus, the present invention includes a system 48 which is particularly useful for moving girders and other heavy construction equipment and items to and from at a construction cite. Assemblies 52, 54, 168, 169, 59, etc., cooperate to provide a safe, simple and cost effective way of moving items at construction cites which is particularly useful in the railroad industry.

It should be understood that the apparatuses described above are only exemplary and do not limit the scope of the invention, and that various modifications could be made by those skilled in the art that may fall under the scope of the invention. For example, while the hoist assemblies 56 and 58 described above are preferred, clearly any types of hoist mechanism could be employed. In addition, while there are two hoise assemblies, the system would still be useful if there were only a single assembly. Moreover, while the invention is described as having two configurations, extended and retracted, clearly other intermediate configurations would be possible. To this end, a plurality of apertures could be provided in each of beams 118, 127, 119 and 128 so that those beams could be locked in any of several different configurations to provide several different distances between assemblies 52 and 54.

It should also be noted that the inventive system could easily be equipped with locomotive capabilities so that it could move itself and an additional supply car to and from construction sites. Moreover, the present invention could clearly be used in industries other than the railroad industry.

Also, importantly, the mechanisms used to move assembly 59, assemblies 52 and 54, assemblies 168 and 169 and assemblies 56 and 58 could be any of a plurality of well known motivation mechanisms used in the art and should not be limited to the mechanisms described herein. Furthermore, while the invention preferably includes lateral extension assemblies which extend to both sides of carriage 50, the invention could be practiced wherein the extensions extend to only a single side and assemblies 52 and 54 are moveable therealong. Moreover, while the invention is described as having four assemblies 60*a* through 60*d*, clearly the invention could be practiced wherein there are one, two, three or some other number of assemblies, depending on stability requirements.

In addition, referring to FIG. 3 and as suggested above, the upper surface 62 of the deck 50 may be equipped with a plurality of rollers that rotate about axes that are parallel to the upper surface 62 and perpendicular to the length of the deck 50. To withstand the weight of a construction item, the rollers should be constructed of steel and supported on solid, thick axles. The external surface of each wheel may be provided with a rubber sheath in order to minimize slippage between the wheel and a girder thereon. When so equipped, a girder can be placed on deck 62 and rolled from one end of the deck to the other to alleviate strain on the system components.

To apprise the public of the scope of this invention the following claims are made:

I claim:

1. A crane apparatus comprising:

(a) a carriage including a deck and at least one truck mechanism connected to an undersurface of the deck, the deck including forward and rearward edges and first and second lateral edges;

(b) at least one support member having a distal end, the support member mounted to the deck such that the distal end is laterally extendable from the first edge;

(c) first and second glide beams, the first beam coupled to the distal end for movement along a movement axis parallel to a first beam length, the second beam coupled to the deck so as to be essentially parallel and spaced apart from the first beam and for movement essentially parallel to the movement axis;

(d) at least one support beam having first and second ends, the first end coupled to the top of the first glide beam and the second end coupled to the top of the second glide beam, the support beam having a variable length component perpendicular to the first glide beam length; and (e) at least one lifting mechanism coupled to the support beam, the lifting mechanism including a strand having upper and lower ends and a connector connected to the lower end;

(f) wherein the support member is moveable between at least a retracted position and an extended position, when in the retracted position, the distal end adjacent the first lateral edge and when in the extended position, the distal end separated from the first lateral edge, and, wherein, the glide beams are moveable parallel to the movement axis relative to the carriage.

2. The apparatus of claim 1 further including a motivator for moving the support member between the extended and retracted positions.

3. The apparatus of claim 2 wherein the motivator is a hydraulic motor.

4. The apparatus of claim 1 wherein the support member is a first support member and the apparatus further includes a second support member having a distal end and mounted to the deck such that the distal end is laterally extendable from the second edge, the second glide beam coupled to the second support member distal end for movement parallel to the movement axis.

5. The apparatus of claim 4 wherein the first and second support members are a first member pair and the apparatus further includes at least a second support member pair including third and fourth support members having distal ends, the first and second pairs spaced apart along the deck length between the forward and rearward edges, the first glide beam coupled to the first and third support member distal ends and the second glide beam coupled to the second and fourth support member distal ends for movement along the movement axis.

6. The apparatus of claim 5 wherein the apparatus further includes more than two support member pairs spaced apart along the deck length.

7. The apparatus of claim 1 wherein the support beam has a fixed length which forms a variable angle with the first glide beam length and is pivotally coupled at the first and second ends to the tops of the first and second glide beams, the variable angle and support beam length component perpendicular to the first glide beam changeable as the support member is moved between the retracted and extended positions.

8. The apparatus of claim 7 wherein the support beam is a first support beam and the apparatus further includes a second support beam spaced apart from the first support beam, the second support beam having first and second ends which are coupled for pivotal movement to the tops of the first and second glide beams, respectively, the first and second support beams arranged such that they are essentially parallel, the lifting mechanism coupled to and supported by both the first and second support beams.

9. The apparatus of claim 8 wherein the first and second support beams constitute a first beam pair, the lifting mechanism constitutes a first lifting mechanism and the apparatus further includes a second beam pair including third and fourth support beams and also includes a second lifting mechanism, the third and fourth support beams pivotally coupled to the tops of the first and second glide beams in a spaced apart relationship and the second lifting mechanism coupled to the second beam pair.

10. The apparatus of claim 1 wherein, the lifting mechanism includes a hoist assembly for increasing and decreasing the length of the strand.

11. The apparatus of claim 1 wherein upper edges of the first and second glide beams form channels which extend along at least a portion of respective glide beams, the support beam coupled to first and second roller assemblies at first and second ends, respectively, the roller assemblies receivable within the channels and moveable therealong so as to change the position of the support beam relative to the glide beams.

12. The apparatus of claim 1 wherein an upper edge of the support beam upper forms a channel and the lifting mechanism includes a roller assembly receivable within the channel and moveable therealong so as to change the position of the lifting mechanism along the length of the support beam.

13. The apparatus as recited in claim 1 wherein the deck forms a carrying surface.

14. The apparatus as recited in claim 1 wherein the carriage is a flat bed train car and the truck mechanism consisting of two train trucks.

15. The apparatus as recited in claim 1 further including at least one motivator for moving the glide beams relative to the deck.

16. The apparatus as recited in claim 1 wherein the support beam includes two separated and parallel beams, the strand passing therethrough.

17. The apparatus as recited in claim 9 further including first and second brace beams having variable lengths which extend between and substantially perpendicular to the first and second glide beams, the brace beams positioned adjacent the forward and rearward edges of the deck.

18. The apparatus of claim 1 wherein the support beam has a fixed length which forms a variable angle with the first glide beam length and is pivotally coupled at first and second ends to the tops of the first and second glide beams, the variable angle and support beam length component perpendicular to the first glide beam changeable as the support member is moved between the retracted and extended positions.

19. The apparatus of claim 18 wherein the support beam is a first support beam and the apparatus further includes a second support beam spaced apart from the first support beam, the second support beam having first and second ends which are coupled for pivotal movement to the tops of the first and second glide beams, respectively, the first and second support beams arranged such that they are essentially parallel, the lifting mechanism coupled to and supported by both the first and second support beams.

20. The apparatus of claim 19 wherein the first and second support beams constitute a first beam pair, the lifting mechanism constitutes a first lifting mechanism and the apparatus further includes a second beam pair including third and fourth support beams and also includes a second lifting mechanism, the third and fourth support beams pivotally coupled to the tops of the first and second glide beams in a spaced apart relationship and the second lifting mechanism coupled to the second beam pair.

21. The apparatus of claim 20 wherein, the lifting mechanism includes a hoist assembly for increasing and decreasing the length of the strand.

22. The apparatus of claim 21 wherein upper edges of the first and second glide beams form channels which extend along at least a portion of respective glide beams, the support beam coupled to first and second roller assemblies at first and second ends, respectively, the roller assemblies receivable within the channels and moveable therealong so as to change the position of the support beam relative to the glide beams.

23. The apparatus of claim 1 wherein an upper edge of the support beam upper forms a channel and the lifting mechanism includes a roller assembly receivable within the channel and moveable therealong so as to change the position of the lifting mechanism along the length of the support beam.

24. The apparatus of claim 23 further including at least one motivator for moving the glide beams relative to the deck.

25. The apparatus of claim 1 further including first and second brace beams, the first brace beam coupled to the first glide beam and extending toward the second glide beam and the second brace beam coupled to the second glide beam proximate the first brace beam and extending toward the first glide beam, the first and second glide beams connectible in either the extended or retracted positions for locking the glide beams in either the extended or retracted positions.

26. The apparatus of claim 25 wherein the first and second brace members include first and second sets of brace members, respectively, the first and second sets connectible for locking the glide beams in either the extended or retracted positions.

* * * * *